US006192635B1

(12) United States Patent
Zheng

(10) Patent No.: US 6,192,635 B1
(45) **Date of Patent: *Feb. 27, 2001**

(54) MULTIPURPOSE COLLAPSIBLE PANELS

(75) Inventor: Yu Zheng, Walnut, CA (US)

(73) Assignee: Patent Category Corp., Walnut, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/294,268

(22) Filed: Apr. 19, 1999

Related U.S. Application Data

(63) Continuation-in-part of application No. 09/207,183, filed on Dec. 9, 1998.

(51) Int. Cl.[7] ..... E04H 15/40; A63B 63/00

(52) U.S. Cl. ..... 52/126; 52/97; 52/143; 473/471; 273/398; 273/402; 446/487

(58) Field of Search ..... 135/125, 126, 135/143, 97, 117, 96; 473/471, 478, 479, 197; 273/397–398, 393, 400, 401, 402, 407, 350; 160/370.21, 370.2; 482/35, 148; 446/487–488, 119

(56) References Cited

U.S. PATENT DOCUMENTS

| | | | | |
|---|---|---|---|---|
| 3,201,126 | * | 8/1965 | Nissen | 273/401 |
| 4,204,357 | | 5/1980 | Harrington . | |
| 4,241,533 | | 12/1980 | Newsome . | |
| 4,709,928 | | 12/1987 | Willingham . | |
| 4,815,784 | | 3/1989 | Zheng . | |
| 4,832,652 | | 5/1989 | Matsuyama . | |
| 5,024,262 | | 6/1991 | Huang . | |
| 5,098,108 | * | 3/1992 | McKinney | 273/400 |
| 5,116,273 | * | 5/1992 | Chan | 160/370.2 |
| 5,261,846 | | 11/1993 | Hanna . | |
| 5,326,299 | * | 7/1994 | Jasinski | 446/46 |
| 5,358,440 | | 10/1994 | Zheng . | |
| 5,377,577 | * | 1/1995 | Bounkong et al. | 89/36.05 |
| 5,427,381 | * | 6/1995 | Macaluso et al. | 273/400 |
| 5,553,908 | * | 9/1996 | Shink | 296/97.7 X |
| 5,671,479 | * | 9/1997 | Dedrick | 2/46 |
| 5,722,446 | | 3/1998 | Zheng . | |
| 5,778,915 | * | 7/1998 | Zheng | 135/126 |
| 5,816,954 | | 10/1998 | Zheng . | |
| 5,927,793 | * | 7/1999 | McGrath, Jr. | 296/136 |

FOREIGN PATENT DOCUMENTS

| | | | | |
|---|---|---|---|---|
| 2635136 | * | 9/1990 | (FR) | 135/125 |

OTHER PUBLICATIONS

"Kargo Gear" Brochure, by Kel–Gar, Inc., 1998.

* cited by examiner

*Primary Examiner*—Carl D. Friedman
*Assistant Examiner*—Winnie Yip
(74) *Attorney, Agent, or Firm*—Raymond Sun

(57) ABSTRACT

Collapsible structures are provided that have a single panel having a foldable frame member having a folded and an unfolded orientation, with a fabric material covering selected portions of the frame member to form the panel when the frame member is in the unfolded orientation, the fabric assuming the unfolded orientation of the frame member. The single panel can further include an amusement feature provided thereon, or can be used as a cover for an object, a pool, pond, box, case or shelter, or can be used as a base with an opening provided in the fabric through which an object can be inserted. The single panels can even be combined to form structures having different configurations and utility.

10 Claims, 16 Drawing Sheets

MULTIPURPOSE COLLAPSIBLE PANELS

BACKGROUND OF THE INVENTION

1. Related Cases

This is a continuation-in-part of co-pending Ser. No. 09/207,183, entitled "Vertical Stacked Collapsible Structures", filed Dec. 9, 1998, whose disclosure is incorporated by this reference as though fully set forth herein.

2. Field of the Invention

The present invention relates to collapsible structures, and in particular, to collapsible panels which may be provided in a variety of shapes and sizes, and for use in a variety of applications. The collapsible panels may be twisted and folded to reduce the overall size of the panels to facilitate convenient storage and use.

3. Description of the Prior Art

Collapsible structures have recently become popular with both adults and children alike. Examples of such structures are shown and described in U.S. Pat. Nos. 5,038,812 (Norman), 5,467,794 (Zheng) and 5,560,385 (Zheng). These structures have a plurality of panels that may be twisted and folded to reduce the overall size of the structures to facilitate convenient storage and use. As such, these structures are being enjoyed by many people in many different applications.

For example, these structures have been provided in many different shapes and sizes for children's play indoors and outdoors. Smaller versions of these structures have been used as infant nurseries. Even smaller versions of these structures have been used as dollhouses and action figure play houses by toddlers and children.

As another example, these structures have been made into tents or outdoor structures that can be used by adults and children for, hunting, camping or other outdoor purposes. These structures have also been popular as beach cabanas.

Even animals can enjoy these structures. Some of these structures have been made into shelters that can be used by pets, both inside and outside the house.

The wide-ranging uses for these collapsible structures can be attributed to the performace, convenience and variety that these structures provide. When fully expanded, these structures are stable and can be used as a true shelter without the fear of collapse. These structures are easily twisted and folded into a compact configuration to allow the user to conveniently store the structure. The light-weight nature of the materials used to make these structures makes it convenient for them to be moved from one location to another. These structures also provide much variety in use and enjoyment. For example, a child can use a structure both indoors and outdoors for different play purposes, and can use the same structure for camping.

However, many of these collapsible structures are typically provided in a pre-formed configuration which cannot be disassembled without destroying the structure. As a result, the variety of use and play for these structures can be limited.

Thus, there still remains a need for collapsible structures that provide increased variety of play, entertainment value, and utility.

SUMMARY OF THE DISCLOSURE

In order to accomplish the objects of the present invention, the collapsible structures according to the present invention have, in their most basic embodiment, a single panel having a foldable frame member having a folded and an unfolded orientation, with a fabric material covering selected portions of the frame member to form the panel when the frame member is in the unfolded orientation, the fabric assuming the unfolded orientation of the frame member.

In one embodiment, the single panel further includes an amusement feature provided thereon. In another embodiment, the single panel can be used as a cover for an object, a pool, pond, box, case or shelter. In yet a further embodiment, the panel can be used as a base, and has an opening provided in the fabric through which an object can be inserted. The single panels of the present invention can even be combined to form structures having different configurations and utility.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

The collapsible structures according to the present invention are configured in the form of one or more panels. These structures can be folded and collapsed into a compact configuration for convenient storage and transportation.

Figure 1A:
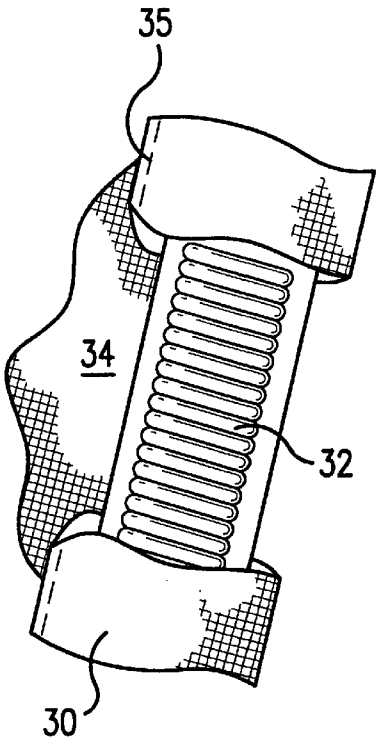
FIG. 1A is a partial cut-away view of the section A of the structure of FIG. 1 illustrating a frame member retained within a sleeve.
Figure 1:
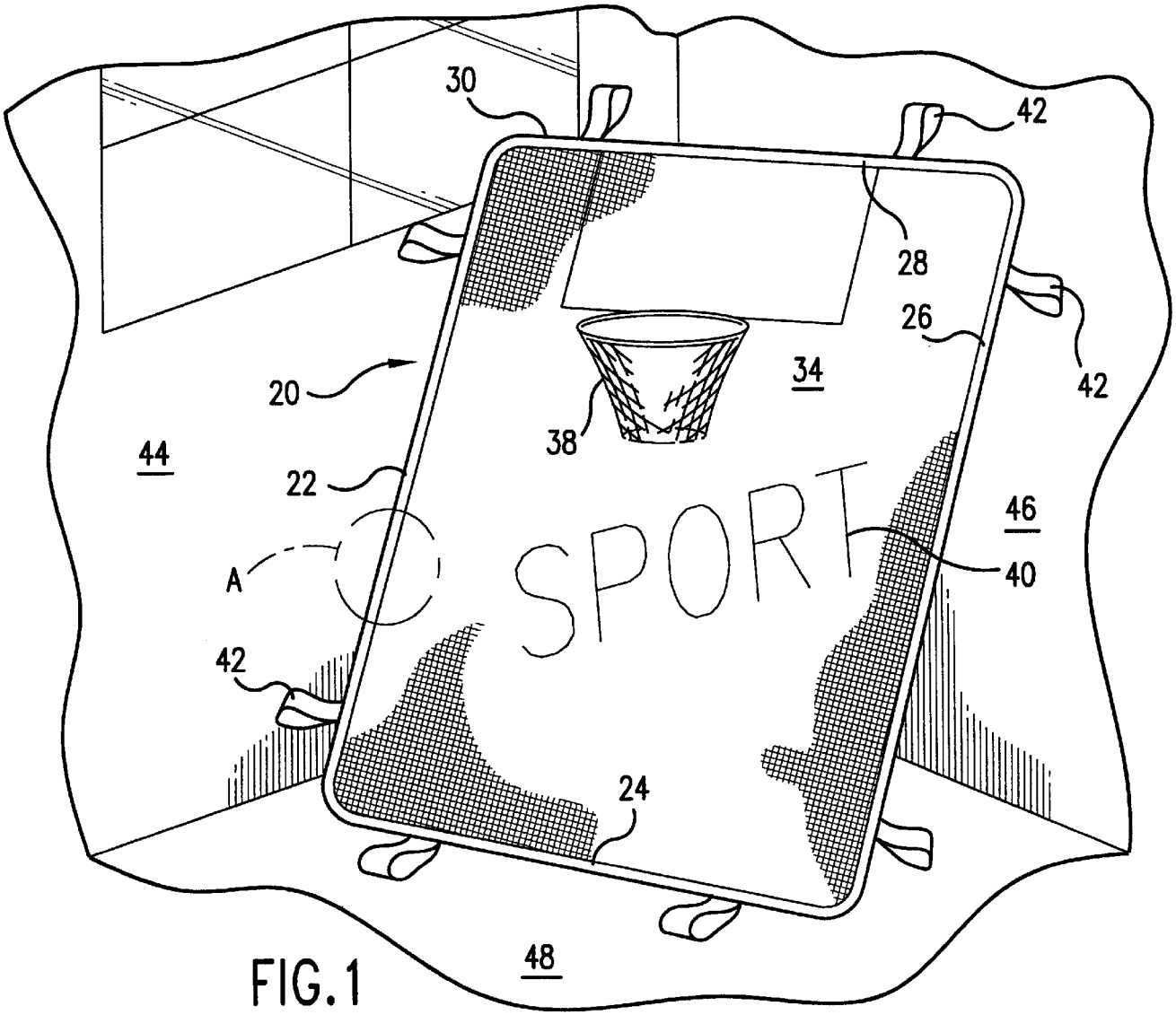
FIG. 1 is a perspective view of a collapsible structure according to one embodiment of the present invention.

FIGS. 1 and 1A illustrate a possible basic embodiment for a collapsible structure according to the present invention which takes the form of a single panel 20. As explained in greater detail hereinbelow, the collapsible structures according to the present invention can each be comprised of one or more of these panels 20 assembled to create a resulting structure having the desired shape and size.

Referring to FIG. 1, according to a first preferred embodiment of the present invention, the structure 20 is a single panel that has four sides, a left side 22, a bottom side 24, a right side 26 and a top side 28. A continuous frame retaining sleeve 30 is provided along and traverses the edges of its four sides 22, 24, 26, 28. As shown in FIG. 1A, a continuous frame member 32 is retained or held within the frame retaining sleeve 30 to support the panel 20.

The continuous frame member 32 may be provided as one continuous loop, or may comprise a strip of material connected at both ends to form a continuous loop. The continuous frame member 32 is preferably formed of flexible coilable steel having a memory, although other materials such as plastics may also be used. The frame member 32 should be made of a material which is relatively strong and yet is flexible to a sufficient degree to allow it to be coiled. Thus, the frame member 32 is capable of assuming two positions or orientations, an open or expanded position such as shown in FIG. 1, or a folded position in which the frame member 32 is collapsed into a size which is much smaller than its open position (see FIG. 14E).

Fabric or sheet material 34 extends across the panel 20, and is held taut by the frame member 32 when in its open position. Fabric 34 can extend completely across the panel 20 to entirely cover the enclosed space defined by the frame member 32, or can extend across selected portions of the enclosed space defined by the frame member 32. The term fabric is to be given its broadest meaning and should be made from strong, lightweight materials and may include woven fabrics, sheet fabrics or even films. The fabric should be water-resistant and durable to withstand wear and tear. The type of material used for the fabric 34 can be varied depending on the intended use. As one non-limiting example, a tough film-like material can be used if the panel 20 is intended for use as a backboard, such as illustrated in FIG. 1. As another non-limiting example, a cloth-like material can be used if the panel 20 is intended primarily for indoor use.

Referring to FIG. 1A, the fabric piece 34 is stitched at its edges by a stitching 35 to the sleeve 30. The sleeve 30 may be formed by folding a piece of fabric, and then applying the stitching 35 to connect the sleeve 30 to the fabric 34. Alternatively, the frame retaining sleeve 30 may be formed by merely folding over the fabric 30 and applying the stitching 35. The frame member 32 may be merely retained within the frame retaining sleeve 30 without being connected thereto. Alternatively, the frame retaining sleeve 30 may be mechanically fastened, stitched, fused, or glued to the frame member 32 to retain it in position.

Amusement features can be provided on the panel 20 of FIG. 1. For example, a netting 38 may be suspended to one or both sides of the fabric 34, at any location thereon. These amusement features can include indicia 40 such as a message, logo, or design that can be imprinted or otherwise provided on one or both sides of the fabric 34, again at any location thereon. Other amusement features, as illustrated in the other embodiments herein, can also be incorporated and provided on the panel 20.

The panel 20 also includes one or more detachable connectors or removable attachment mechanisms 42 (referred to herein as "attachment mechanisms"), such as Velcro pads, hooks, ties, straps, double-sided tape, suction cups, or similar mechanisms, that are provided along one or more of the sides 22, 24, 26, 28. The attachment mechanisms 42 can be used to attach or couple the panel 20 to other supporting structures or objects, as illustrated below. The number of attachment mechanisms 42 provided, and the locations of these attachment mechanisms 42 along the sides 22, 24, 26, 28, can be varied depending on the application (i.e., use) of the panel 20, and the supporting objects or structures (and the locations of these supporting objects or structures) that are to be used to support the panel 20. For example, the panel 20 in FIG. 1 can be used as an amusement or play structure providing a backboard for a netting 38 through which a ball can be tossed. As shown in FIG. 1, the panel 20 can be supported at a corner between two adjacent walls 44 and 46, with the bottom side 24 resting on the floor 48. The attachment mechanisms 42 can be used to removably attach the panel 20 to the walls 44, 46 and the floor 48.

Each basic panel 20 can be used as a building block and combined with other basic panels to provide structures having different shapes and sizes, as illustrated below.

Figure 2A:
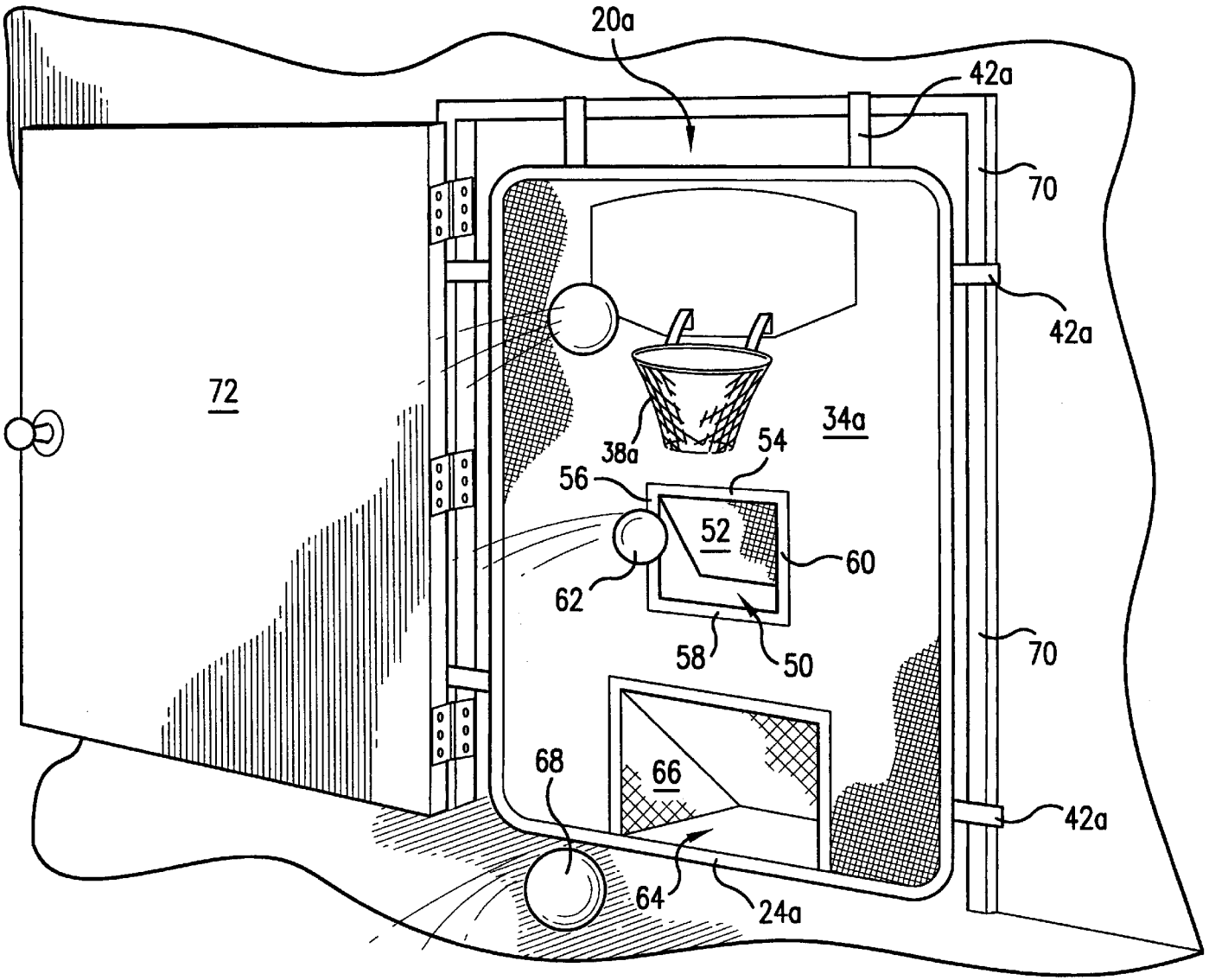
FIGS. 2A and 2B are perspective views of a collapsible structure according to another embodiment of the present invention.

FIG. 2A illustrates a panel 20*a* that includes modifications to the panel 20. The elements of the panel 20*a* that are the same as the elements of the panel 20 are provided with the same numeral designations except that an "a" has been added to the numeral designations in FIG. 2. The panel 20*a* differs from panel 20 in that two additional amusement features have been added. First, an opening 50 is provided at about the center of the panel 20*a*. A flap or covering 52 is attached to a top edge 54 of the opening 50. For example, the flap 52 can be formed by merely cutting the other three sides 56, 58, 60 of the opening 50 from the fabric 34*a*, or the flap 52 can be a separate piece that is stitched to the top edge 54 after the opening 50 has been created. Thus, a user can toss a ball or object 62 through the opening 50 and flap 52.

Second, another opening 64 may be provided adjacent the bottom side 24*a*, and netting 66 stitched or otherwise connected to the rear side of the panel 24*a* to form a soccer goal for receiving a ball 68. In addition, the attachment mechanisms 42*a* can be embodied in the form of long straps or ties that can be tied or secured to, for example, the surrounding frame 70 of a door 72. Thus, the panel 24*a* can be set up in the opening of a doorway for play. Different balls can be tossed or kicked at either the netting 38*a*, the opening 50 or the goal 64.

Figure 2B:
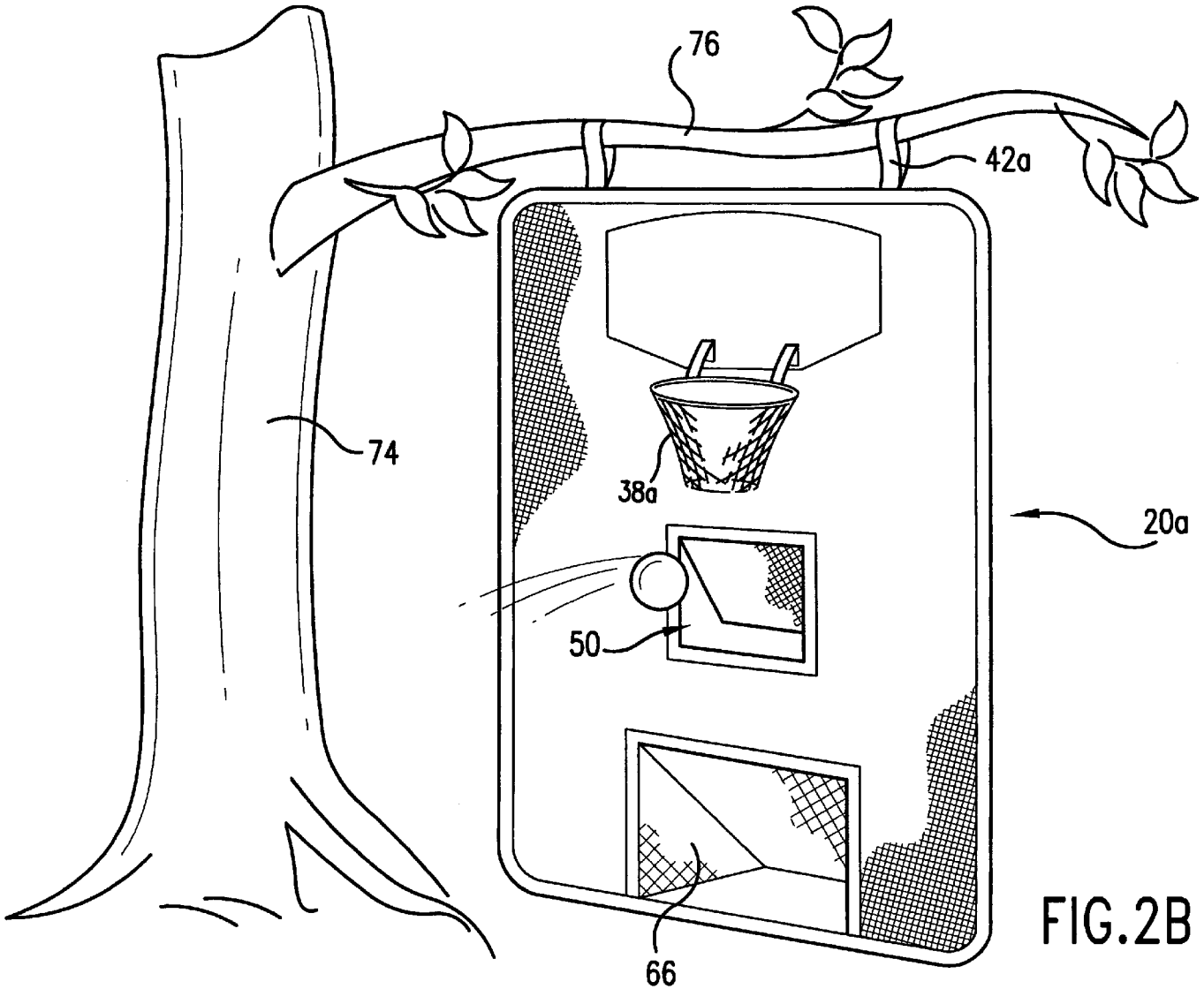

FIG. 2B illustrates the same panel 20*a* used outdoors and being supported from a branch 76 of a tree 74 via the attachment mechanisms 42*a*, which in this example can be straps. Thus, the panel 20*a* presents an amusement structure that can be used indoors and outdoors.

Figure 3:
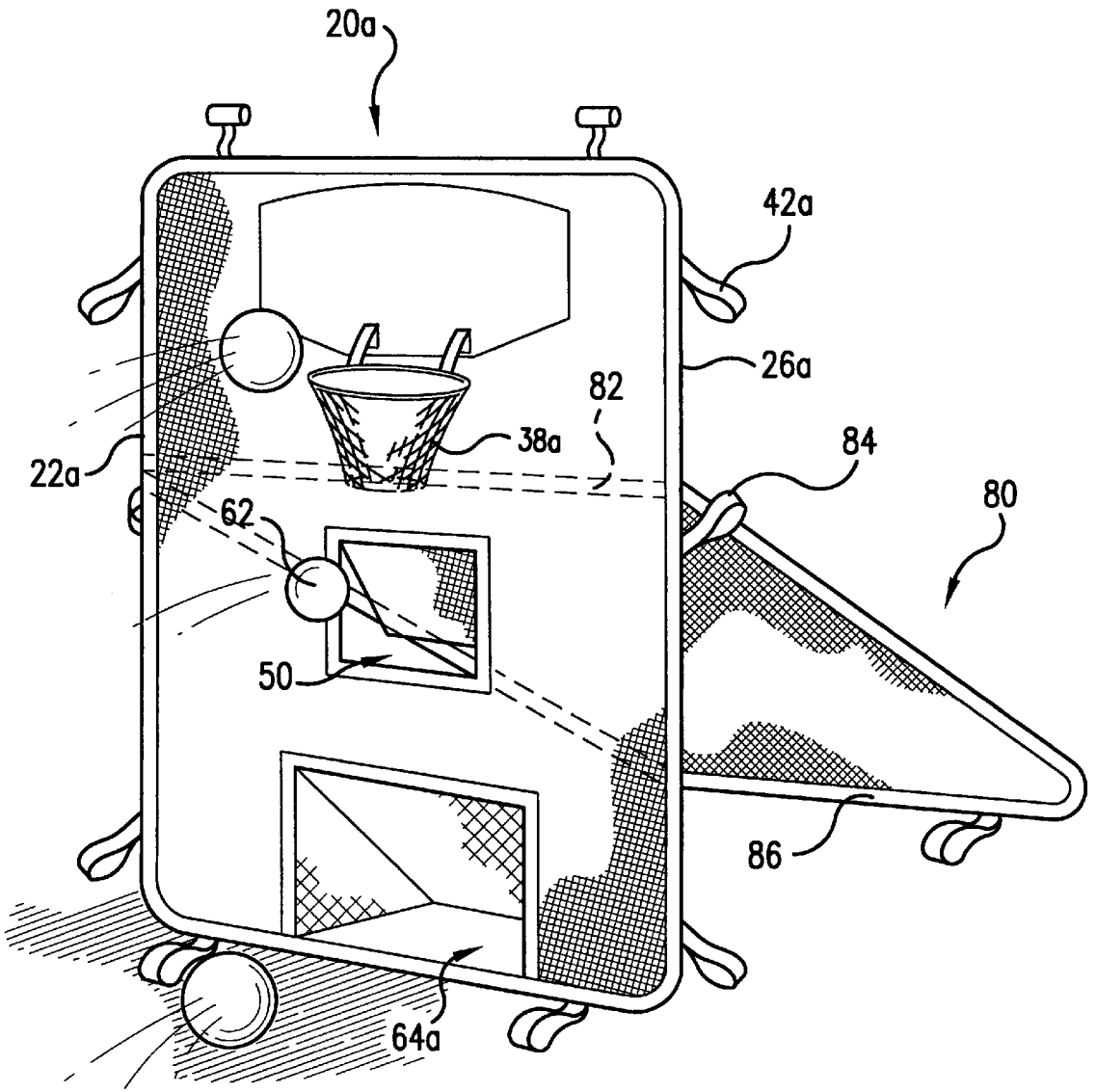
FIGS. 3, 4, 5A and 5B are perspective views illustrating how the structure of FIG. 2 can be configured with other panels to form collapsible structures having different configurations.
Figure 4:
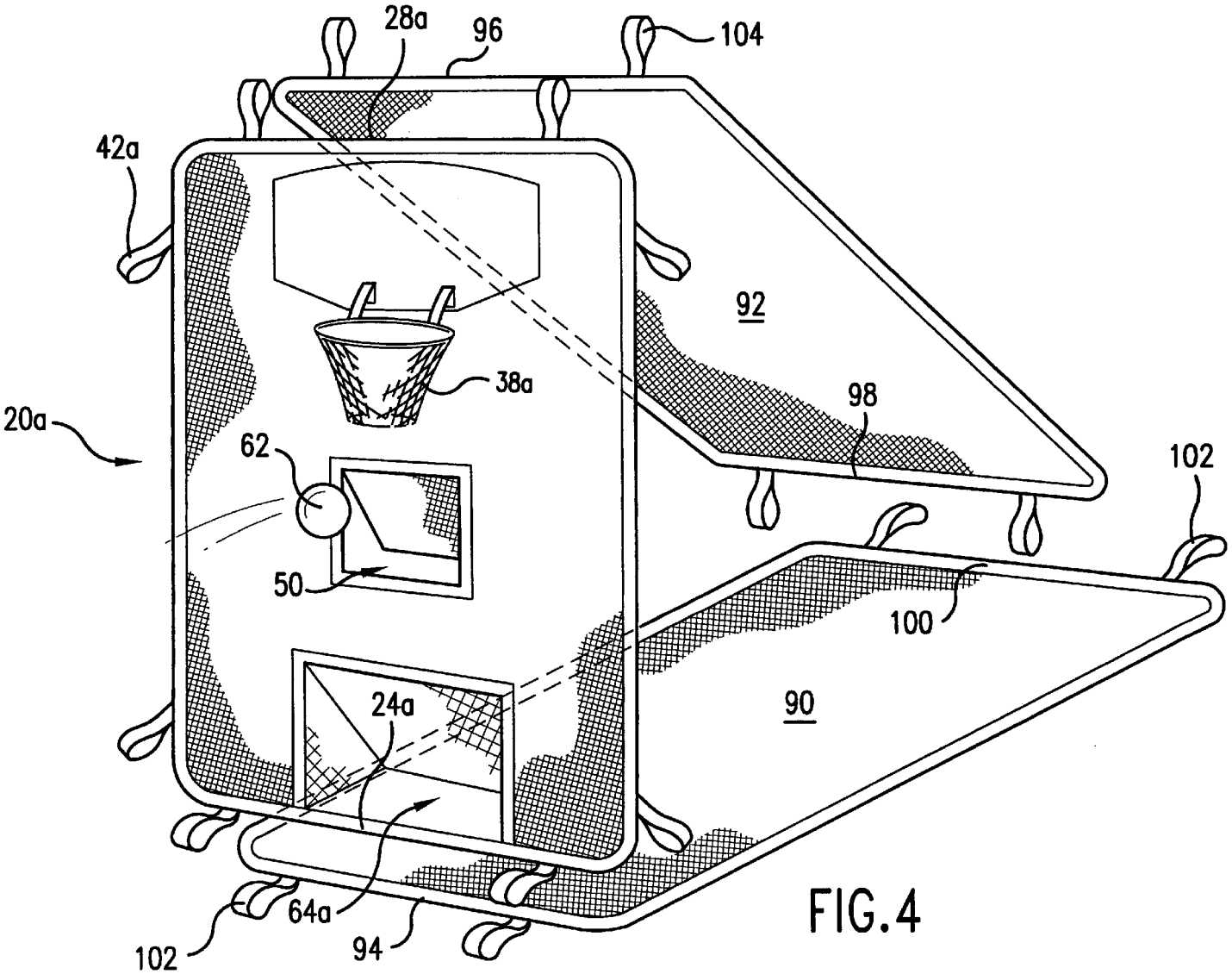

FIGS. 3–5 illustrate how the panel 20*a* can be supported by other panels that act as the supporting structure for the panel 20*a*. In FIG. 3, another panel 80 is provided, with panel 80 having the same structure as panel 20 except that certain amusement features can be omitted. Panel 80 can be positioned at an angle with respect to the ground and panel 20*a*, and a top side 82 of the panel 80 can be removably secured to the panel 20*a* to act as a back-support to keep the panel 20*a* at a generally vertical orientation. The panel 80 can be provided with one or more attachment mechanisms 84 that can be attached to the sides (e.g., 22*a*, 26*a*), or the attachment mechanisms 42*a*, of the panel 20*a*. The bottom side 86 of the panel 80 rests on the ground, at an angle, to support the entire structure (which is comprised of panels 20*a* and 80).

The structure shown in FIG. 3 can be disassembled by detaching all the attachment mechanisms 42*a*, 84 to separate the two panels 20*a*, 80. The two panels 20*a*, 80 can then be placed one on top of the other to create a stack of two panels that can be twisted and folded together in the manner described in FIGS. 14A–14E below.

In FIG. 4, two other panels 90 and 92 are provided, with panels 90, 92 having the same structure as panel 20 except that certain amusement features can be omitted. Panel 90 can be positioned flat on the ground or surface, with a first side 94 removably secured to the bottom side 24*a* of the panel

20*a*. Panel 92 can be positioned at an angle with respect to the ground and panel 20*a*, and a top side 96 of the panel 92 can be removably secured at an angle to the top side 28*a* of the panel 20*a* to act as a back-support to keep the panel 20*a* at a generally vertical orientation. The bottom side 98 of panel 92 is removably secured at an angle to a second side 100 of panel 90. The panels 90 and 92 can be provided with one or more attachment mechanisms 102 and 104, respectively, that can either be removably attached to the sides of the other panels, or to the other attachment mechanisms 42*a*, 102, 104 to obtain the configuration shown in FIG. 4. Thus, the completed structure in FIG. 4 is comprised of three panels 20*a*, 90, 92.

The structure shown in FIG. 4 can be disassembled by detaching all the attachment mechanisms 42*a*, 102, 104 to separate the three panels 20*a*, 90, 92. The three panels 20*a*90, 92 can then be placed one on top of the other to create a stack of three panels that can be twisted and folded together in the manner described in FIGS. 14A–4E below. Alternatively, the attachment mechanisms 42*a*, 104 can first be detached, the panel 92 folded on top of panel 90 about the hinge created by the connection between the bottom side 98 and the second side 100, and the panel 20*a* folded on top of panel 92 about the hinge created by the connection between the bottom side 24*a* and the first side 94, to create a stack of three panels that can be twisted and folded together in the manner described in FIGS. 14A–14E below.

Figures 5A, 5B:
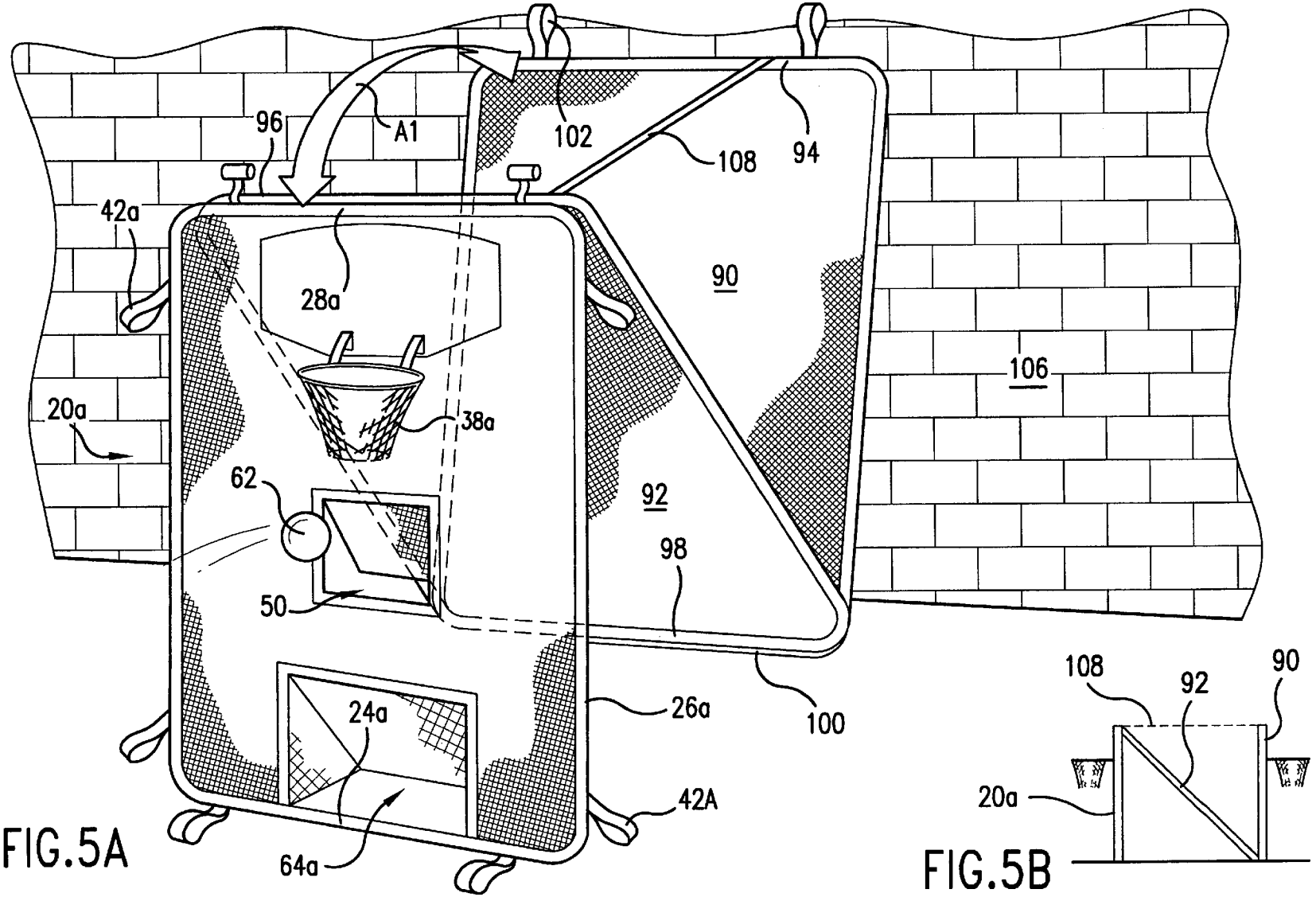

In FIG. 5A, the configuration of the panels 20*a*, 90 and 92 is modified to provide a different manner of supporting panel 20*a* in a vertical upright orientation. Here, the couplings of the panels 20*a*, 90, 92 are the same as in FIG. 4, except that panel 90 no longer serves as a floor or base support. Instead, support panel 90 is now positioned vertically. In particular, the first side 94 of panel 90 is no longer coupled to the bottom side 24*a* of panel 20*a*, and panel 90 is pivoted about its hinged connection with panel 92 (at sides 98 and 100) so that panel 90 stands either vertically upright or at an angle. For example, as shown in FIG. 5A, the panel 90 can stand at an angle with respect to the floor or ground so that its side 94 is rested against a wall 106. In this position (i.e., with panels 90 and 92 angled), the panel 20*a* can be supported in a generally vertical position without the assistance of any other supports. As an alternative, a string or strap 108 can be used to couple one side (e.g., 26*a*) of the panel 20*a* to any side of the panel 90. When the string or strap 108 couples both panels 20*a* and 90 (see FIG. 5B), both panels 20*a* and 90 can be positioned vertically (with panel 92 angled between panels 20*a* and 90) with the entire structure essentially self-supporting (i.e., no other supporting walls or panels are needed for the structure to stay in its erected position). In any case, the configuration shown in FIG. 5A provides panel 92 between panels 20*a* and 90, which provides better support for panel 20*a* if the size of panel 20*a* is larger.

The configuration shown in FIG. 5A can be disassembled by detaching all the attachment mechanisms 42*a*, 102, 104 to separate the three panels 20*a*, 90, 92, as described above for FIG. 4. Alternatively, the panel 90 can be folded on top of panel 92 about the hinge created by the connection between the bottom side 98 and the second side 100 (see arrow A1), and the panel 20*a* folded against panel 92 about the hinge created by the connection between the top sides 28*a* and 96, to create a stack of three panels that can be twisted and folded together in the manner described in FIGS. 14A–14E below.

Thus, FIGS. 4, 5A and 5B illustrate different ways in which a collection of panels can be used to provide support to a single panel 20*a*. As an illustration of the flexibility of the single panels of the present invention, the panels 90 and 92 can also be provided with amusement features.

Figure 6:
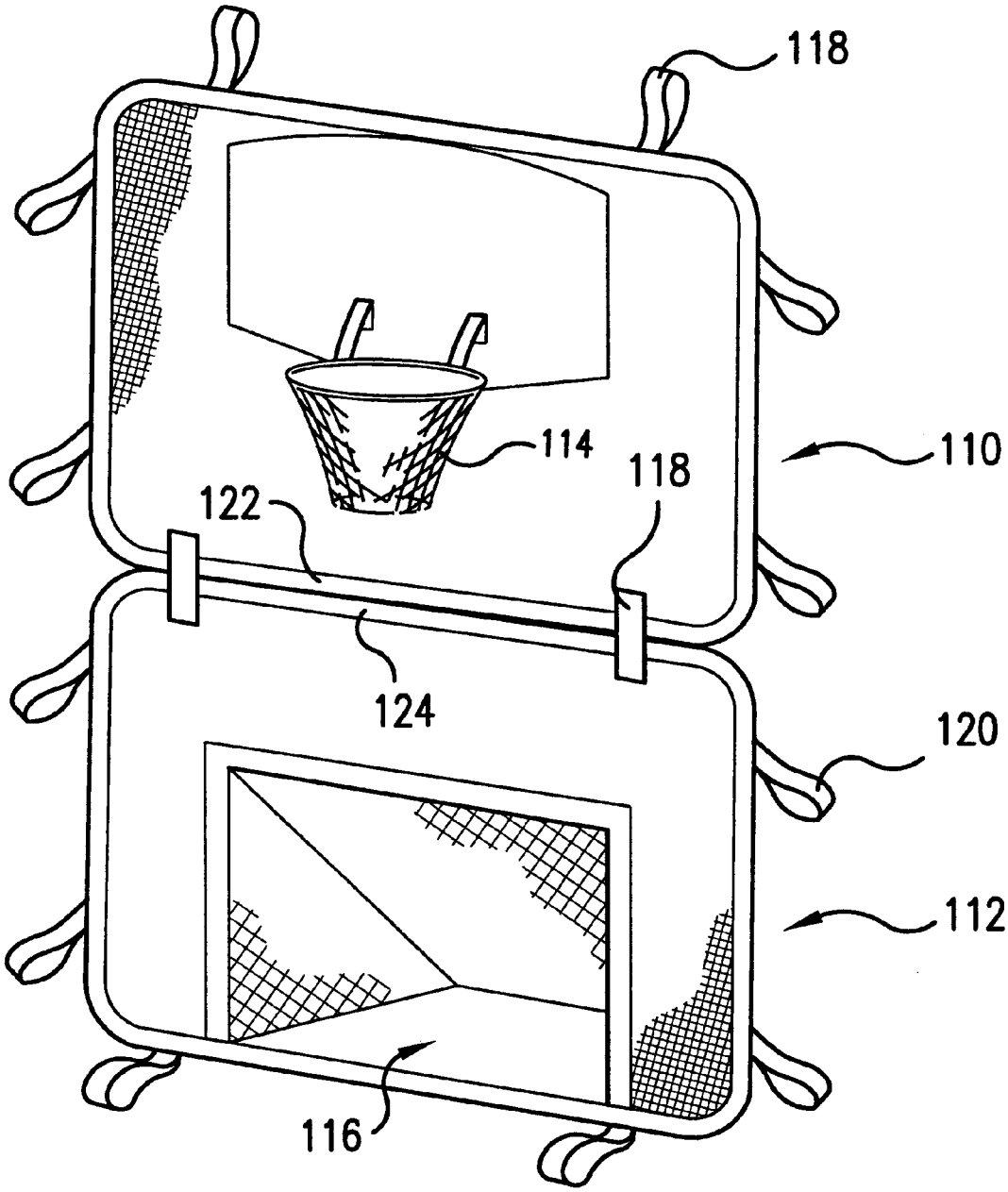
FIG. 6 is a perspective view of a collapsible structure according to yet another embodiment of the present invention.

Single panels having different amusement features can also be combined to create a structure having multiple amusement features. A simple and non-limiting example is illustrated in FIG. 6, where two single panels 110 and 112 are provided. Each panel 110, 112 can have the same construction as panel 20. Panel 110 has a netting 114, while panel 112 has a goal 116. Panels 110 and 112 have attachment mechanisms 118 and 120, respectively, that can be coupled to create a structure out of the two panels 110, 112. For example, the bottom side 122 of panel 110 can be coupled to the top side 124 of panel 112 to configure panel 110 above panel 112. However, many other configurations can be provided. For example, the panels 110, 112 can be positioned side-by-side.

The structure shown in FIG. 6 can be disassembled by detaching all the attachment mechanisms 118, 120 to separate the two panels 110, 112. The two panels 110, 112 can then be placed one on top of the other to create a stack of two panels that can be twisted and folded together in the manner described in FIGS. 14A–14E below. Alternatively, the panels 110, 112 can be folded on top of each other about the hinge created by the connection between the bottom side 124 and the top side 122, to create a stack of two panels that can be twisted and folded together in the manner described in FIGS. 14A–14E below.

Figure 7:
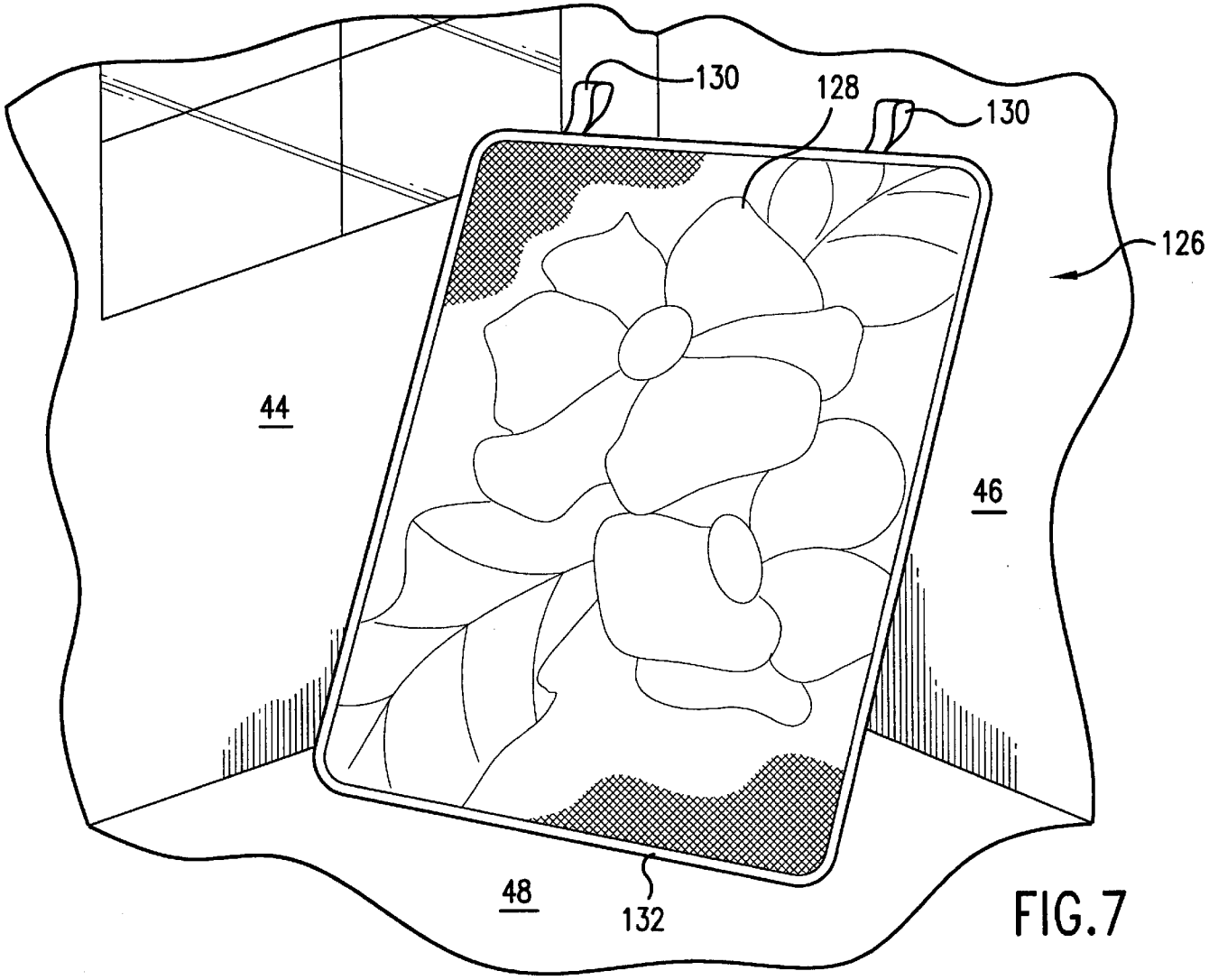
FIGS. 7–13 are perspective views of collapsible structures according to further embodiments of the present invention.

While FIGS. 1–6 illustrate panels that support amusement features, the single panels according to the present invention can also be used for other applications. For example, FIG. 7 illustrates a single panel 126 that can have the same construction as panel 20 of FIG. 1, except that panel 126 is used to display a decorative design or pattern 128. Attachment mechanisms 130 can be provided for coupling to supporting structures. For example, panel 126 can be supported at a corner between two adjacent walls 44 and 46, with the bottom side 132 rested on the floor 48. The attachment mechanisms 130 can be used to removably attach the panel 126 to the walls 44, 46 and the floor 48.

Figure 8:
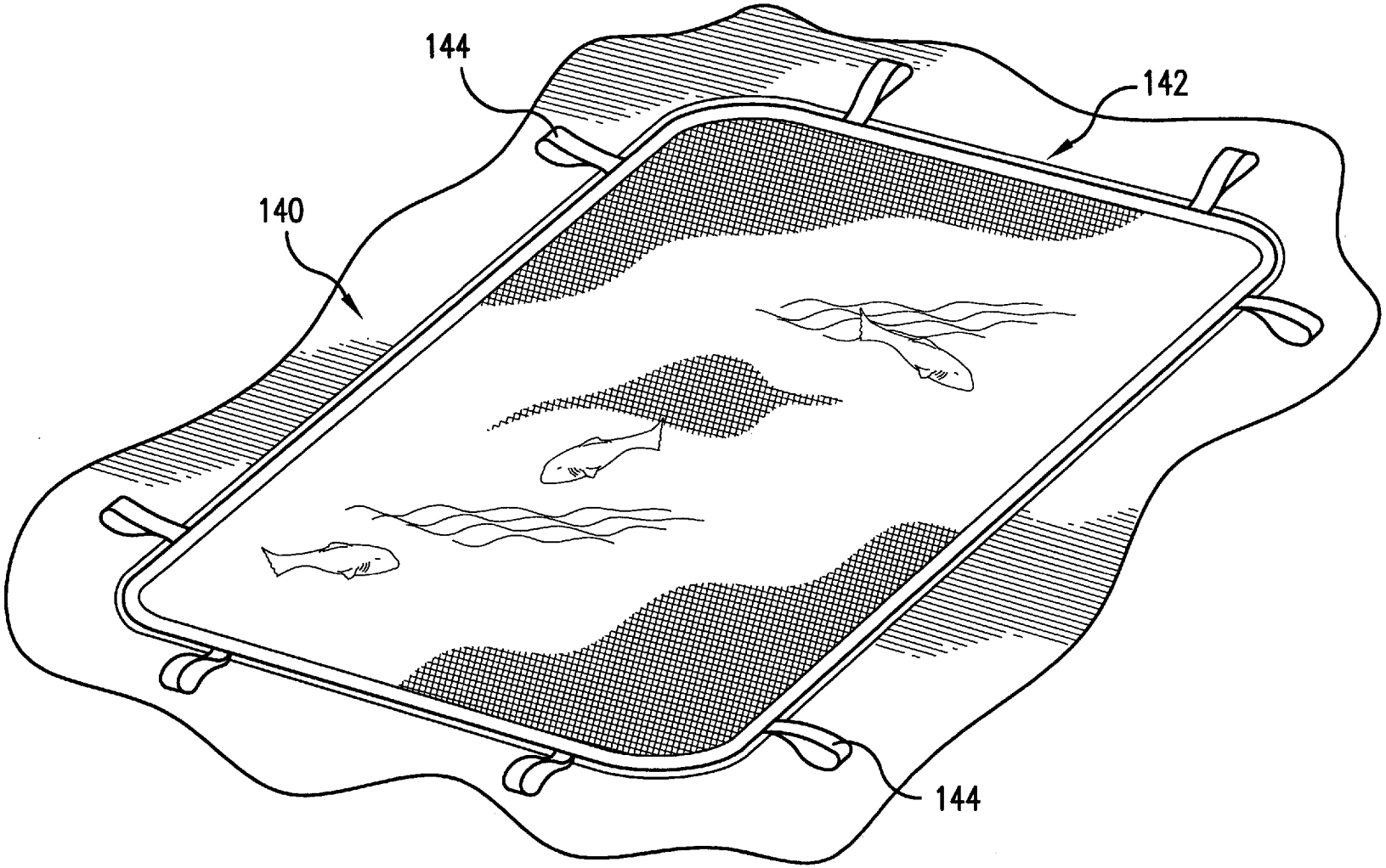

As another example, FIG. 8 illustrates a single panel 140 that can have the same construction as panel 20 of FIG. 1, except that panel 140 can be used to cover a pool or pond 142. Attachment mechanisms 144 can be provided for coupling to the ground, or other supporting structures (e.g., posts, handle bars, etc.) on the ground or adjacent the pool or pond, so as to maintain the panel 140 in proper position over the pool or pond 142. Use as a pool or pond cover enables the panel 140 to be useful and effective in preventing children, leaves and other objects from falling into the pool or pond, and in protecting fish in the pond from being eaten by cats or other predators.

Figure 9:
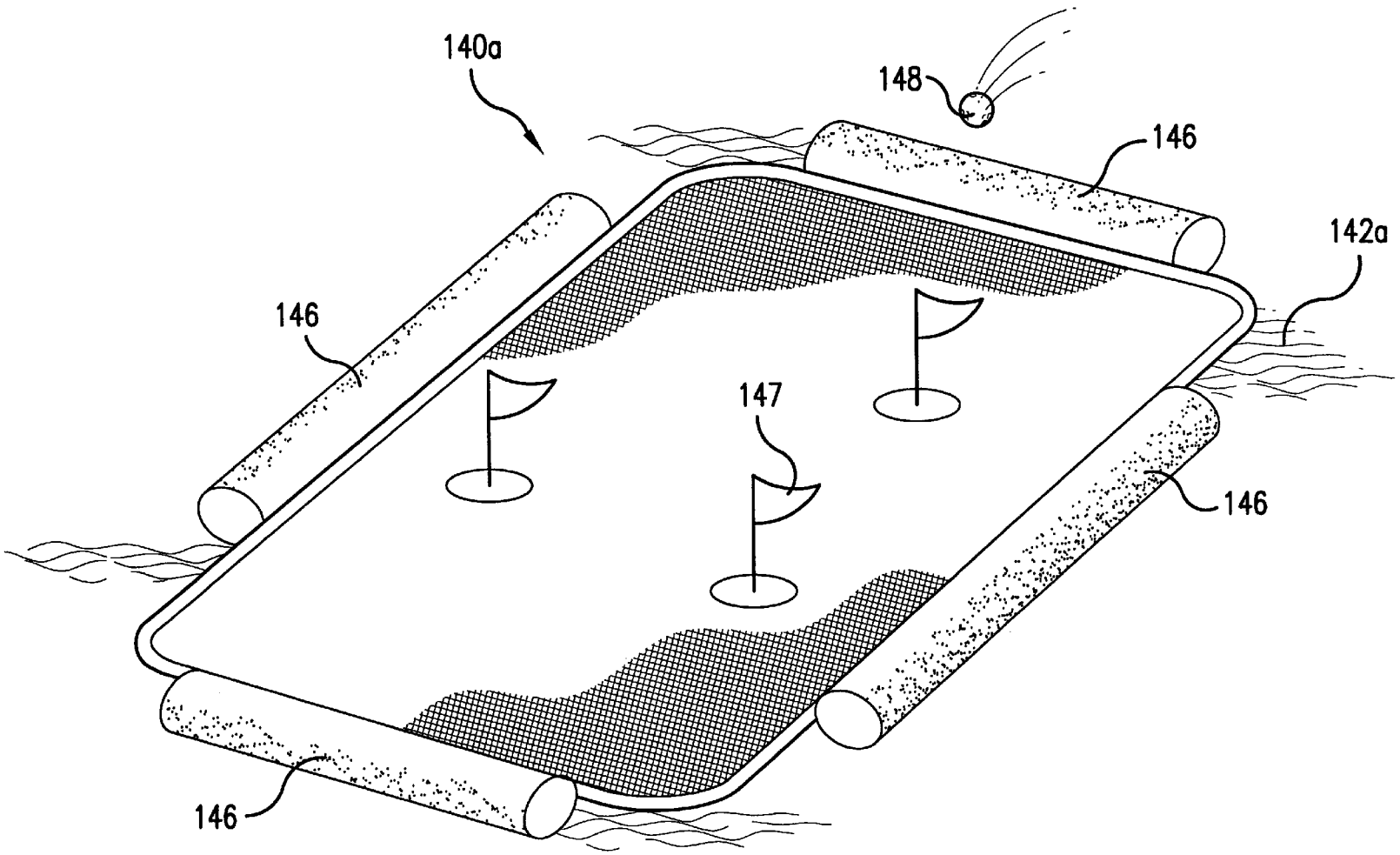

FIG. 9 illustrates another possible use for the panel 140. The elements of the panel 140*a* in FIG. 9 that are the same as the elements of the panel 140 are provided with the same numeral designations except that an "a" has been added to the numeral designations in FIG. 9. In FIG. 9, flotation devices 146 can be provided in lieu of, or in addition to, the attachment mechanisms 144. The flotation devices 146 can take the form of any conventional flotation device, such as inflated plastic tubes, foam tubes, or the like, and can be permanently or removably secured (e.g., using attachment mechanisms such as 144) to the sides of the panel 140*a*. Thus, the flotation devices 146 allow the panel 140*a* to be used to cover a pool or pond 142*a* that does not lend itself to being conveniently secured by attachment mechanisms 144. In addition, panel 140*a* can be embodied to include amusement features, which in FIG. 9 are embodied in the form of golf flags 147 that form targets for balls 148 to be shot or tossed at.

Figure 10:
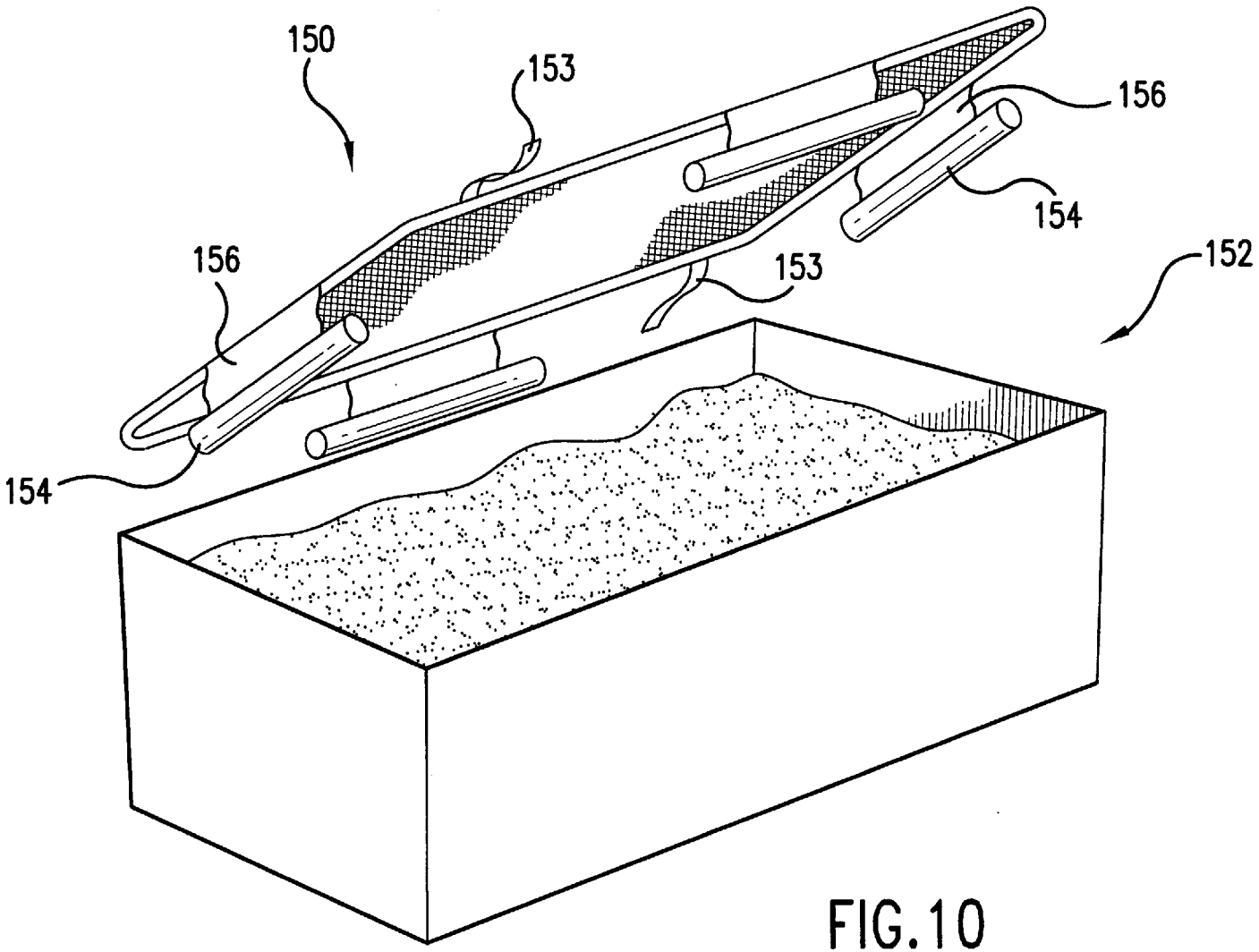

As yet another example, FIG. 10 illustrates a single panel 150 that can have the same construction as panel 20 of FIG. 1, except that panel 150 can be used to cover a box or case 152. Attachment mechanisms 153 can be provided along the sides of the panel 150 for coupling to the sides of the box 152, so as to maintain the panel 150 in proper position over the box 152. As an alternative, or in addition, to the attachment mechanisms 153, handle bars 154 can also be attached to the panel 150 via a fabric piece 156 that is attached (e.g., by stitching) to the panel 150. The handle bars 154 can have sufficient weight so that the panel 150 can act as a lid that can be placed over the top of the box 152, with the combined weight of the handle bars 154 preventing the panel 150 from being moved away from the box 150, so as to render it unnecessary to latch or otherwise secure the panel 150 to the box 152. The handle bars 154 can be embodied in the form of metal rods, sand bags or any other weighted materials or pieces. The embodiment of FIG. 10 enjoys great utility in that the box 152 can be any box, garden tool box, or even a small shelter such as a hut or shack, so that the panel 150 can effectively be used as a cover for a box or even as a temporary roof for a shelter.

For the embodiments in FIGS. 7–10, it is also possible that two or more other panels (that are like 126, 140, 140*a* and 150) can be coupled together (via the attachment mechanisms 130, 144, 154) to span and cover larger areas, such as walls (for FIG. 7), larger pools and ponds (for FIGS. 8 and 9), and larger boxes (for FIG. 10).

Figure 11:
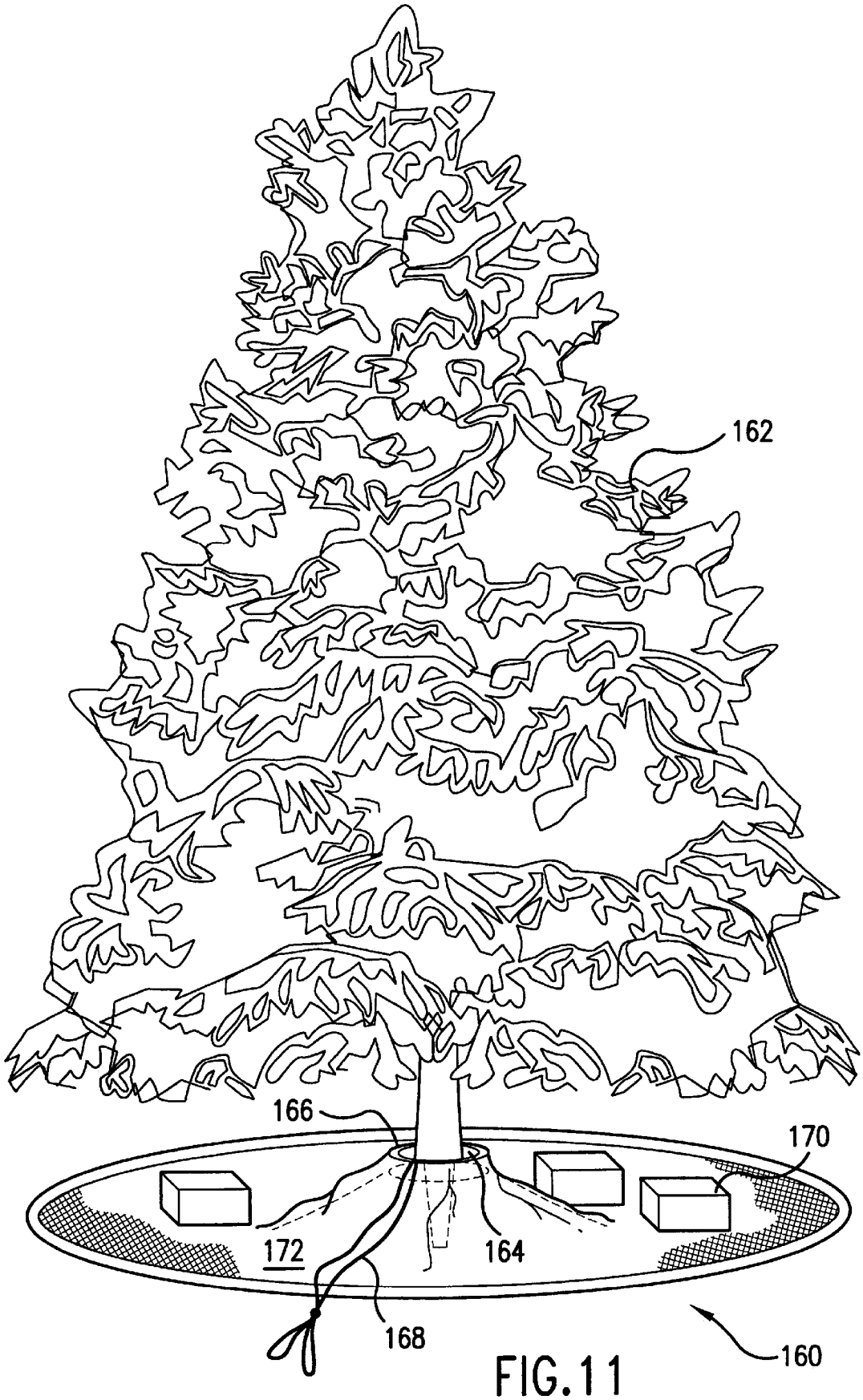

As a further example, FIG. 11 illustrates a single panel that can have the same construction as panel 20 of FIG. 1, except that the panel 160 can be generally circular. The panel 160 can be used as a base for a Christmas tree 162. The panel 160 can have an opening 164 provided at its center. A sleeve 166 can be stitched to the circumference of the opening 164, and a drawstring 168 fitted inside the sleeve 166. When pulled, the drawstring 168 operates to decrease the size of the opening 166. Thus, to use the panel 160, the opening 164 can be stretched to its widest diameter by releasing the drawstring 168. The tree 162 can then be inserted through the widened opening 166 and stood vertically on the ground. At this time, the panel 160 should be lying flat on the ground. The drawstring 168 can then be pulled to decrease the size of the opening 164. Gift packages 170 can then be placed on top of the panel 160. The fabric 172 on panel 160 can be provided with attractive decorative patterns and designs. Thus, the panel 160 provides an attractive base for a Christmas tree 162, and on which gift packages 170 can be placed.

Figure 12:
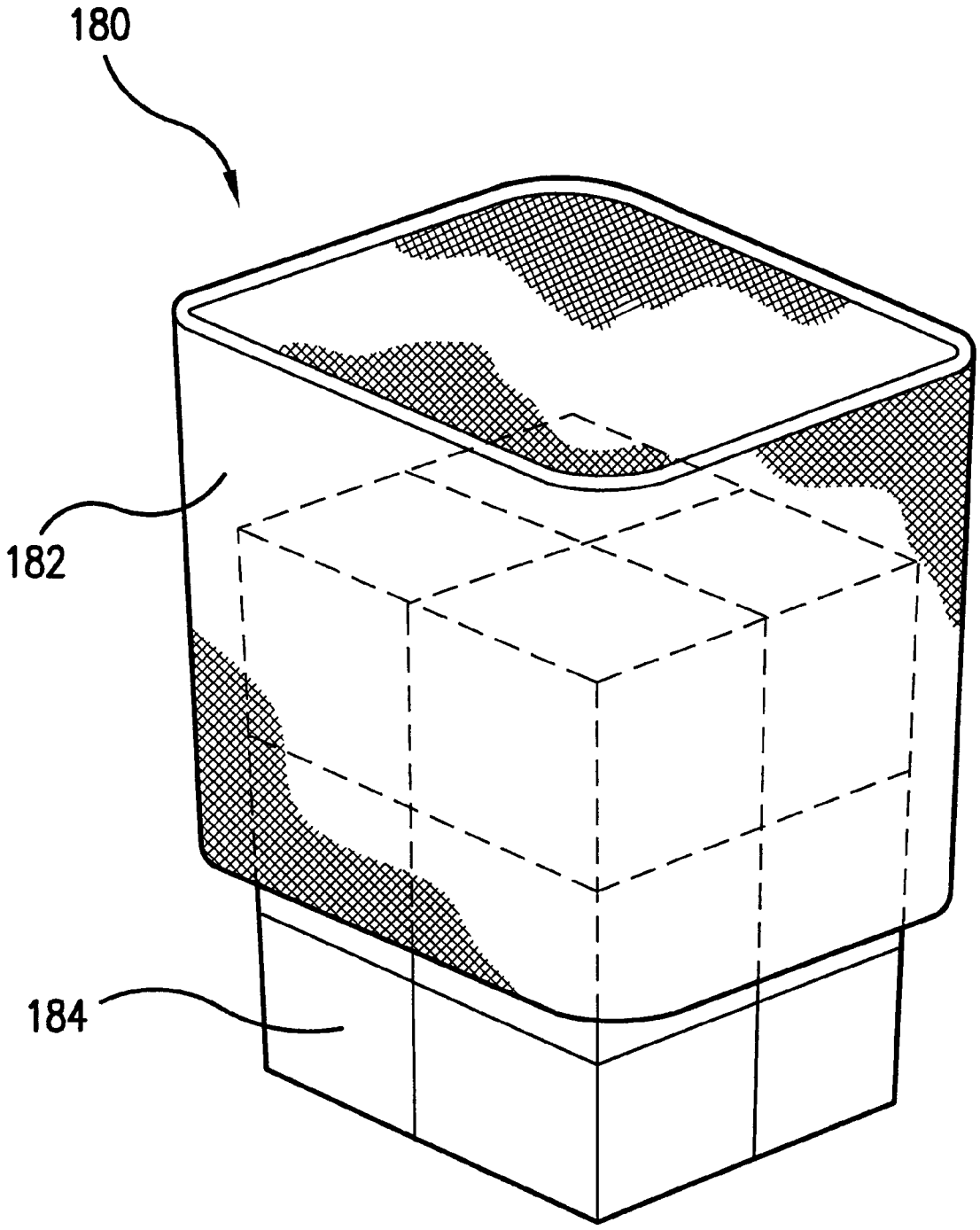

FIG. 12 illustrates a single panel 180 that can have the same construction as panel 20 of FIG. 1, except that the attachment mechanisms 42 can be omitted, and fabric 182 is provided along its four sides to form a fabric wall that encloses an area under the panel 180. The fabric 182 can be stitched, for example, to the sides of the panel 180. As shown in FIG. 12, the panel can be used to cover or drape over an object 184 to protect the object 184 from dust or other dirt and water. The object 184 can be a large and heavy object, such as a pallet that contains numerous boxes packed together.

Figure 13:
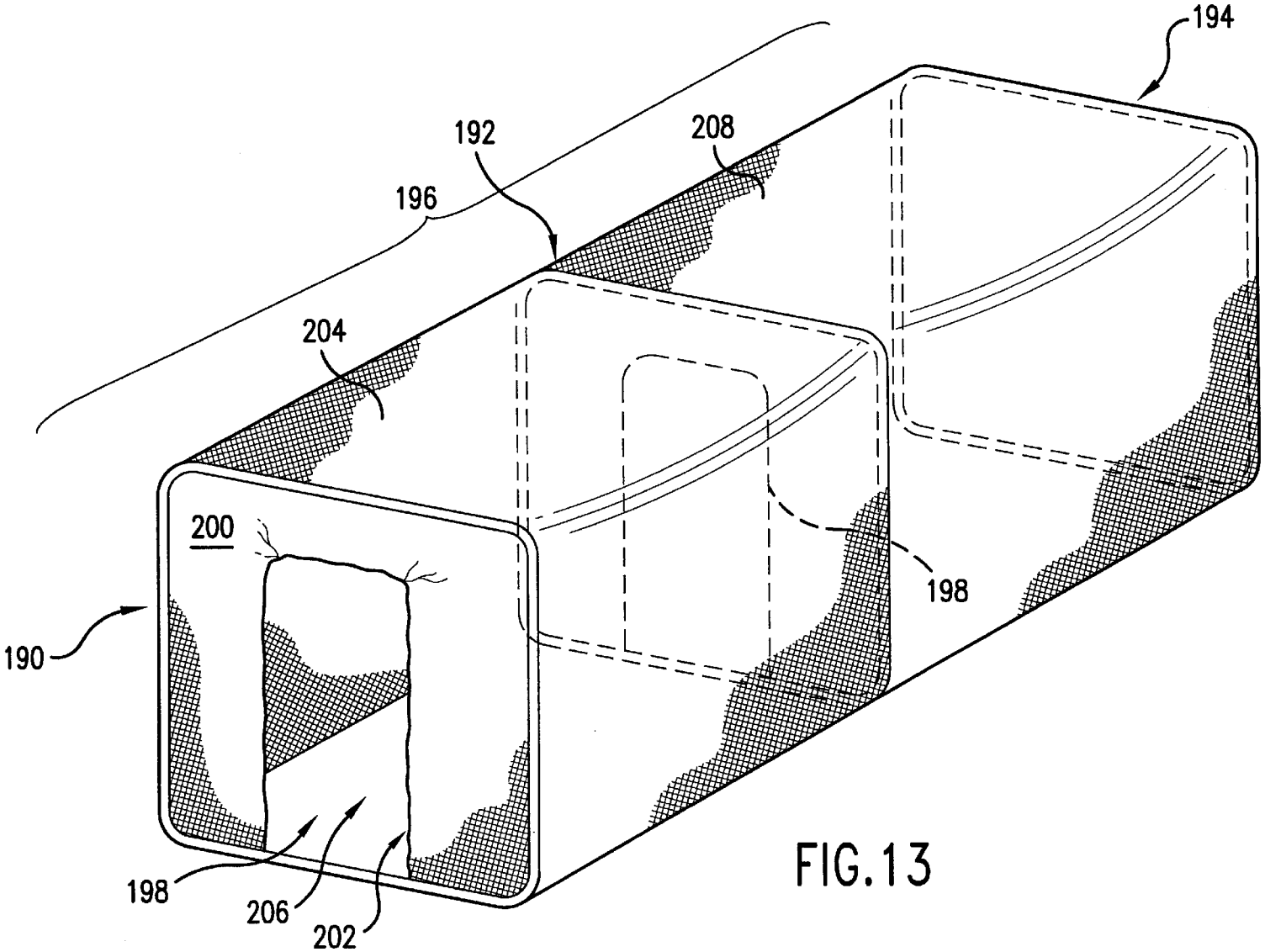

FIG. 13 illustrates another combination of single panels that can be combined to form structures. Three separate panels 190, 192, 194 can be provided in the structure 196 of FIG. 13, with each panel 190, 192, 194 having the same construction as panel 20 of FIG. 1, except that an opening 198 can be provided in the fabric 200 of one or more panels 190, 192, 194. The periphery of each opening 198 can be defined by an elastic band 202 housed in a sleeve. The three panels 190, 192, 194 can be positioned generally parallel to each other and coupled in the manner shown in FIG. 13 to form any variety of different structures, including a tunnel, maze structure, or shelter defining different compartments or rooms. For example, a fabric wall 204 can be stitched to two, three or four of the four sides of both panels 190 and 192 to define a compartment 206 therebetween. Similarly, another fabric wall 208 can be stitched to two, three or four of the sides of both panels 192 and 194 to define another compartment therebetween. Thus, a user can enter the compartment 206 in the structure 196 via the opening 198 in panel 190, and then pass through the opening 198 in panel 192 to enter the next compartment defined by the fabric wall 208. The panel 194 can be provided with an opening 198 to allow ingress to or egress from the compartment defined by the fabric wall 208, or the opening 198 in panel 194 can be omitted so that the only way to enter and exit the compartment defined by the fabric wall 208 would be to pass through the openings 198 in panels 190 and 192.

As an alternative, the opening 198 in panel 192 can be omitted, and the panel 194 provided with an opening 198, so that panel 192 defines a wall separating two compartments defined by the fabric walls 204, 208. As a further alternative, connectors (such as strings or straps) can be used instead of the fabric walls 204 and 208 to couple the panels 190, 192, 194 together. Although FIG. 13 illustrates the use of three panels 190, 192, 194, the structure 196 can be formed from any number of panels to define any number of compartments. For example, the fabric 200 in panel 192 can be completely omitted, so that panel 192 effectively operates as a support frame for a single compartment defined by the end panels 190, 194 and the fabric walls 204, 208.

The structure 196 shown in FIG. 13 can be disassembled by pressing all three panels 190, 192, 194 together to create a stack of three panels (with the fabric walls 204, 208 collapsed between the panels) that can be twisted and folded together in the manner described in FIGS. 14A–14E below.

Figure 14A:
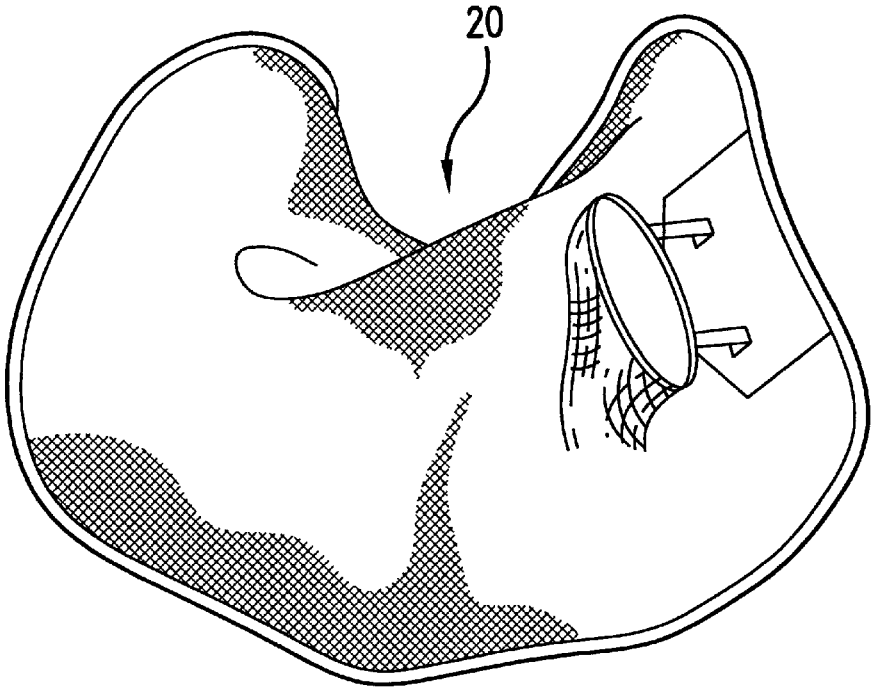
FIGS. 14A though 14E illustrate how the collapsible structure of FIG. 1 may be twisted and folded for compact storage.
Figure 14B:
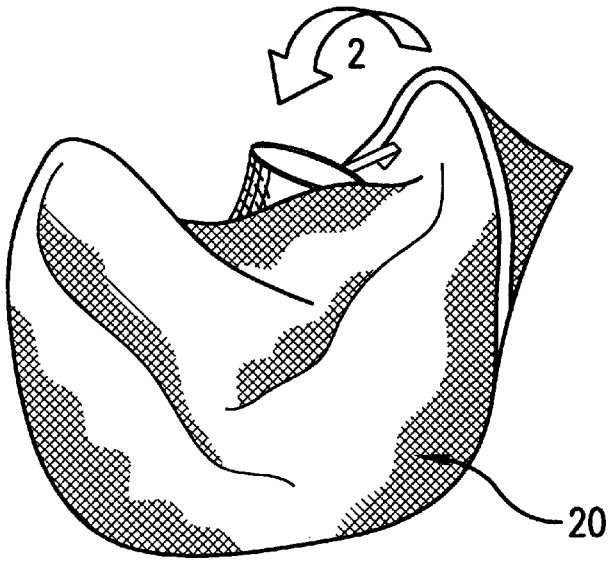
Figure 14C:
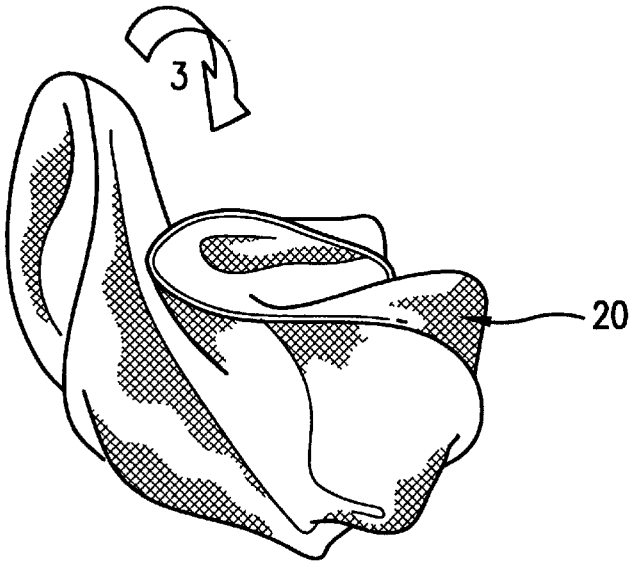
Figure 14D:
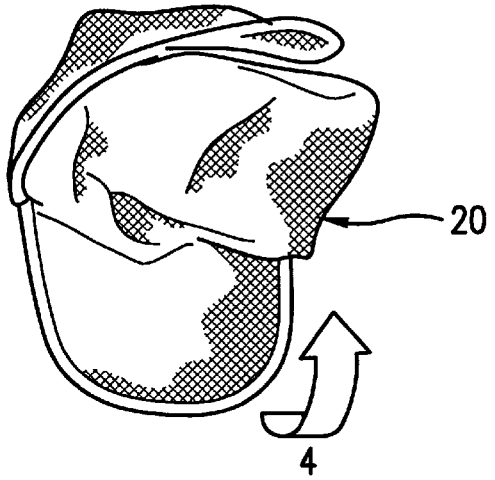
Figure 14E:
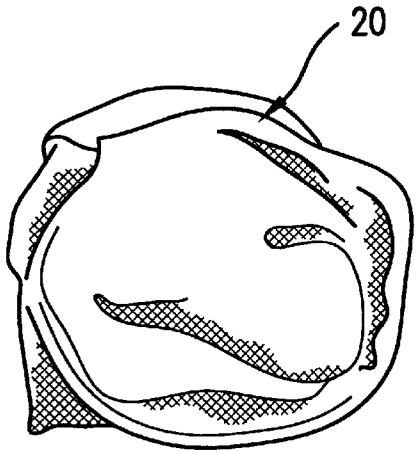

FIGS. 14A through 14E describe the various steps for folding and collapsing the panel 20 of FIG. 1 for storage. In FIG. 14A, one opposing side or border of the panel 20 is folded in to collapse the frame member 32 with the panel 20. As shown in FIGS. 14B–14D, the panel is twisted and folded to continue the collapsing so that the initial size of the panel is reduced. FIG. 14E shows the frame member 32 and panel collapsed on each other to provide for a small essentially compact configuration having a plurality of concentric frame members and layer of the panel 20 so that the collapsed panel has a size which is a fraction of the size of the initial panel.

To re-open the panel 20 to its expanded configuration, the panel 20 is unfolded. The memory (i.e., spring-load) of the frame member 32 will cause the frame member 32 to uncoil on its own and to quickly expand the panel 20 to its expanded configuration shown in FIG. 1. The same principles can be applied to collapse, and to re-open, all the other embodiments of the present invention described above.

Thus, the embodiments of the present invention increase the applications and use of a single panel to provide the user with an unlimited source and variety of fun and entertainment. The single panels can be combined to increase the variety of fun and use. The shapes and sizes of the single panels and the resulting structures can be varied or combined, as well as the entertainment features. These embodiments further illustrate the versatility of the single panels of the present invention, in that these single panels can be used to form the basis for numerous structures that offer an unlimited variety of entertainment and other purposes.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A collapsible structure comprising a single panel having:

a coilable frame member having a folded and an unfolded orientation;

a fabric material covering selected portions of the frame member to form the panel, the fabric material held taut within the frame member when assuming the unfolded orientation of the frame member, so that the fabric material extends in a flat planar configuration when the frame member is in its unfolded orientation; and an amusement feature extending from the fabric material out of the plane of the fabric material.

2. The structure of claim 1, wherein the fabric material has an opening, and the amusement feature includes a flap hinged to the opening for pivoting movement outside the plane of the fabric material.

3. The structure of claim 1, wherein the amusement feature includes a goal extending from the plane of the fabric material.

4. The structure of claim 1, further including means for hanging the panel vertically from a support structure.

5. The structure of claim 1, wherein the single panel has a frame retaining sleeve for retaining the frame member.

6. The structure of claim 1, further including indicia provided on the fabric material.

7. A collapsible structure comprising a single panel having:

a coilable frame member having a folded and an unfolded orientation;

a fabric material covering selected portions of the frame member to form the panel, the fabric material held taut within the frame member when assuming the unfolded orientation of the frame member, so that the fabric material extends in a flat planar configuration when the frame member is in its unfolded orientation; and a flotation device coupled to the panel.

8. The structure of claim 7, wherein the single panel has a frame retaining sleeve for retaining the frame member.

9. The structure of claim 7, further including indicia provided on the fabric material.

10. The structure of claim 7, wherein the fabric material extends in a flat planar configuration when the frame member is in its unfolded orientation, and wherein the structure further includes an amusement feature extending from the fabric material out of the plane of the fabric material.

* * * * *